US007148784B2

(12) United States Patent
Yu

(10) Patent No.: US 7,148,784 B2
(45) Date of Patent: Dec. 12, 2006

(54) SAFETY SWITCH DEVICE

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 294 days.

(21) Appl. No.: 10/855,218

(22) Filed: May 26, 2004

(65) Prior Publication Data

US 2005/0264391 A1 Dec. 1, 2005

(51) Int. Cl.
*H01H 37/52* (2006.01)
*H01H 37/70* (2006.01)

(52) U.S. Cl. ..... 337/66; 337/72; 337/79

(58) Field of Classification Search ..... 337/56, 337/59, 66, 72, 76, 79; 200/339–343
See application file for complete search history.

(56) References Cited

U.S. PATENT DOCUMENTS

| | | | | |
|---|---|---|---|---|
| 2,472,333 | A * | 6/1949 | Short | 337/52 |
| 2,618,716 | A * | 11/1952 | Boller et al. | 335/6 |
| 2,811,606 | A * | 10/1957 | Norden | 337/53 |
| 2,941,058 | A * | 6/1960 | Norden | 337/59 |
| 4,167,720 | A | 9/1979 | Krasser | 337/60 |
| 4,937,548 | A | 6/1990 | Sdunek | 337/70 |
| 5,223,813 | A | 6/1993 | Cambreleng et al. | 337/66 |
| 5,262,748 | A | 11/1993 | Tsung-Mou | 337/66 |
| 5,451,729 | A | 9/1995 | Onderka et al. | 200/18 |
| 5,558,211 | A | 9/1996 | Heydner et al. | 200/553 |
| 5,933,069 | A * | 8/1999 | Huang | 337/66 |
| 6,072,381 | A * | 6/2000 | Yu | 337/37 |
| 6,577,221 | B1 * | 6/2003 | Wang | 337/59 |
| 6,714,116 | B1 * | 3/2004 | Sang et al. | 337/68 |

FOREIGN PATENT DOCUMENTS

DE 2731847 A * 2/1978

* cited by examiner

*Primary Examiner*—Anatoly Vortman

(57) ABSTRACT

A safety switch device includes a case with a switch pivotally engaged with an open top of the case and a ramp defined in an inside of the case. Two terminals are extended from the bottom of the case and a bimetallic plate having a first end fixed to one of the terminals. A distal end of the bimetallic plate is located above the other terminal. A pull rod is pivotally connected to the switch so as to lift the bimetallic plate by a hook portion thereof when switching to "OFF" status. A control member has a first end pivotally connected to the switch member and a probe extended from a second end of the control member. The probe is movably engaged with the ramp and the second end of the control member is movably located above the second end of the bimetallic plate.

7 Claims, 8 Drawing Sheets

SAFETY SWITCH DEVICE

FIELD OF THE INVENTION

The present invention is related to a switch device that includes a ramp with sections of different heights so as to move a control member away from a bimetallic plate in "ON" status, which allows the plate to be deformed without obstruction when the switch device is overloaded.

BACKGROUND OF THE INVENTION

The conventional circuit breaker uses a fuse between a switch and a circuit so that when the circuit breaker is overloaded, the fuse will first melt before damages occur. However, if the fuse is not properly installed or an improper fuse is used, the overload current cannot melt the fuse and a disaster can be caused. U.S. Pat. Nos. 5,262,748, 4,167,720, 4,937,548, 5,223,813, 5,451,729, and 5,558,211 unveil different types of circuit breakers, commonly including a complicated mechanism to drive the bimetallic plate that is expected to be deformed and bent when the circuit breaker is overloaded. Nevertheless, it is noted that the bimetallic plate may not be completely deformed as desired because it can not be freely deformed and is still in contact with the terminal. As a result sparks may be generated cause a disaster.

Therefore, it is desired to have a safety switch device that allows the bimetallic plate to be freely deformed when the switch device is overloaded thus to overcome the shortcomings of the conventional switch devices.

SUMMARY OF THE INVENTION

In accordance with an aspect of the present invention, it provides a safety switch device that comprises a case having an open top and a switch pivotally engaged with the open top of the case. A first terminal and a second terminal are respectively extended through a bottom of the case. A bimetallic plate has a first end fixed to the first terminal and a first contact point is connected to a second end of the bimetallic plate. A second contact point is connected to the second terminal and located beneath the first contact point. A pull rod has a first end pivotally connected to the switch and a second end of the pull rod has a hook portion to lift the second end of the bimetallic plate when the switch is pivoted to "OFF" position. A control member has a first end pivotally connected to the switch member and a probe extends from a second end of the control member so as to be movably engaged with a ramp defined in an inside of the case. The second end of the control member is movably located above the second end of the bimetallic plate.

The present invention will be more obvious from the following description as taken in connection with the accompanying drawings, which show, for purposes of illustration only, a preferred embodiment in accordance with the present invention.

DETAILED DESCRIPTION OF THE PREFERRED EMBODIMENT

Figure 1:
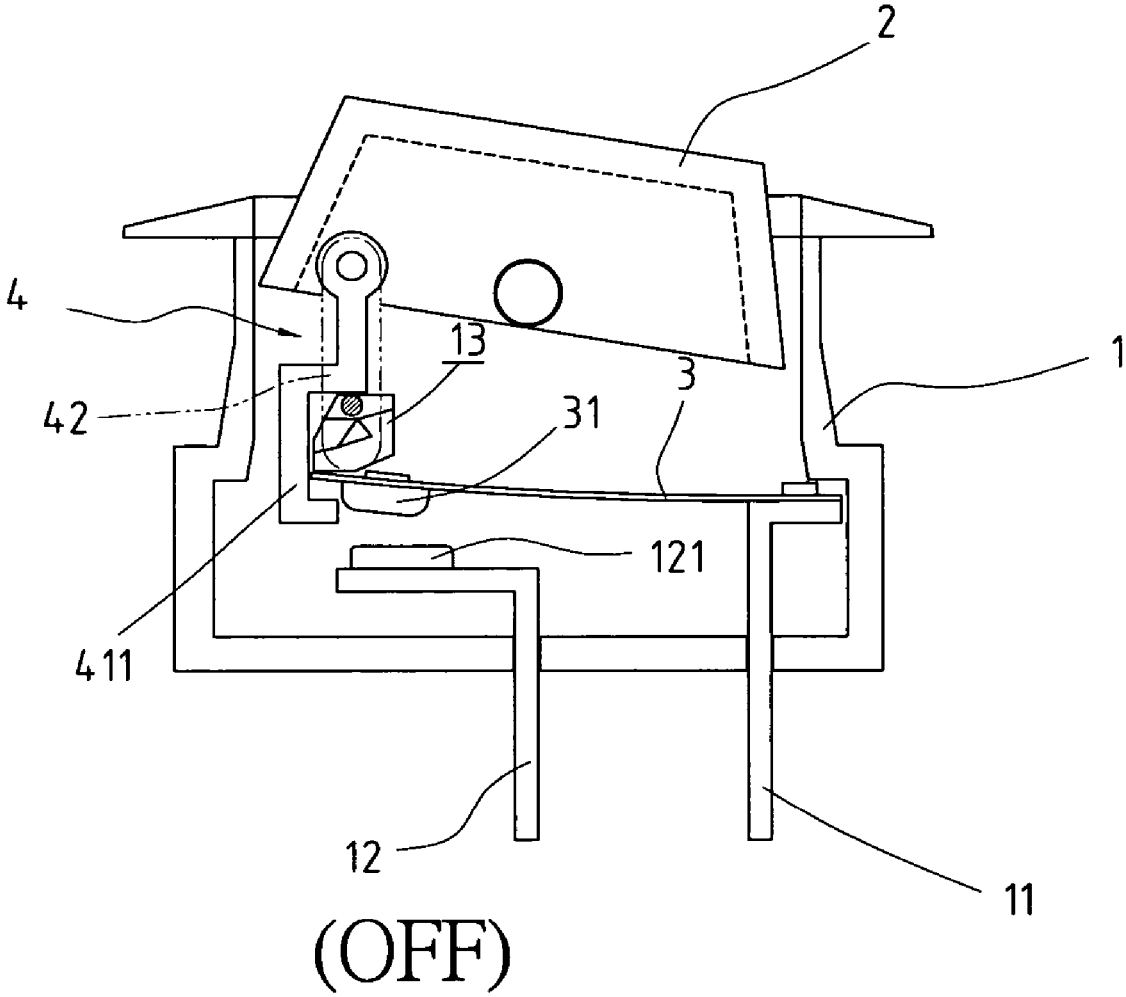
FIG. 1 shows "OFF" status of the switch device of the present invention.
Figure 2:
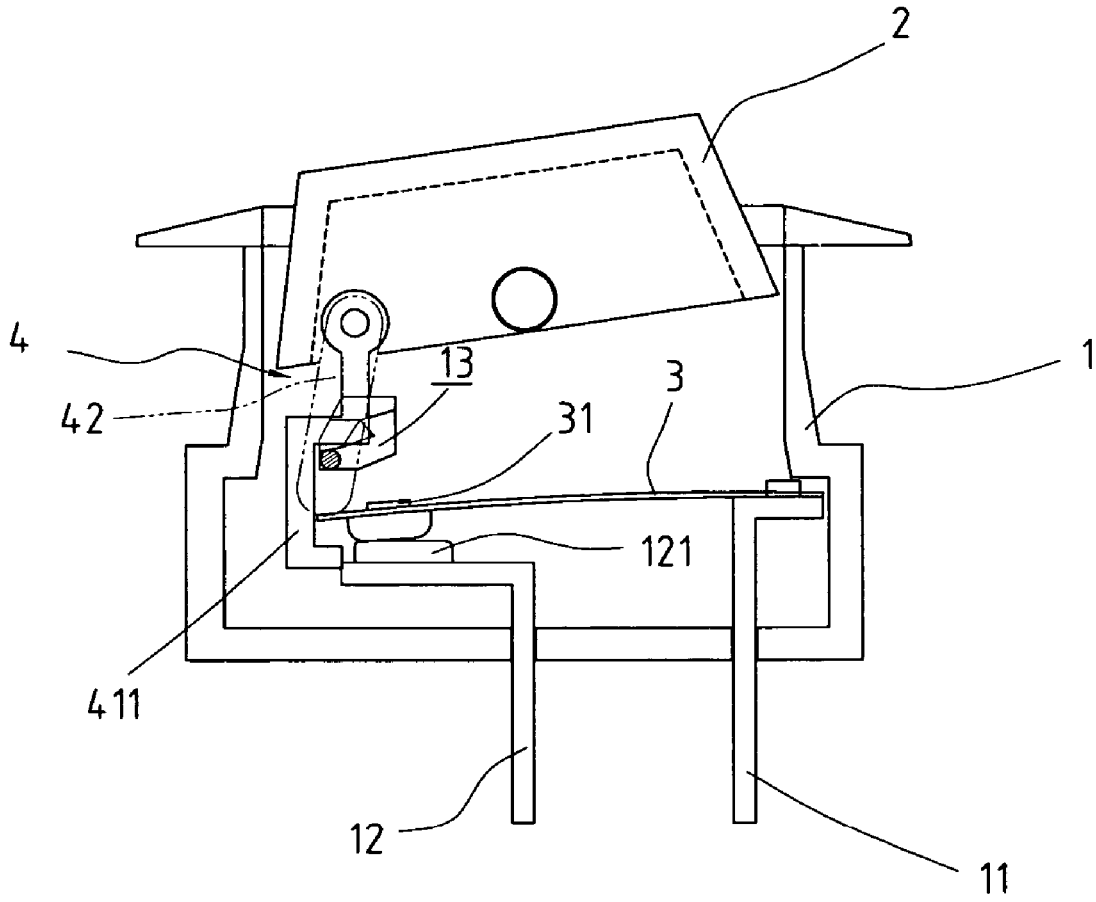
FIG. 2 shows "ON" status of the switch device of the present invention.
Figure 4:
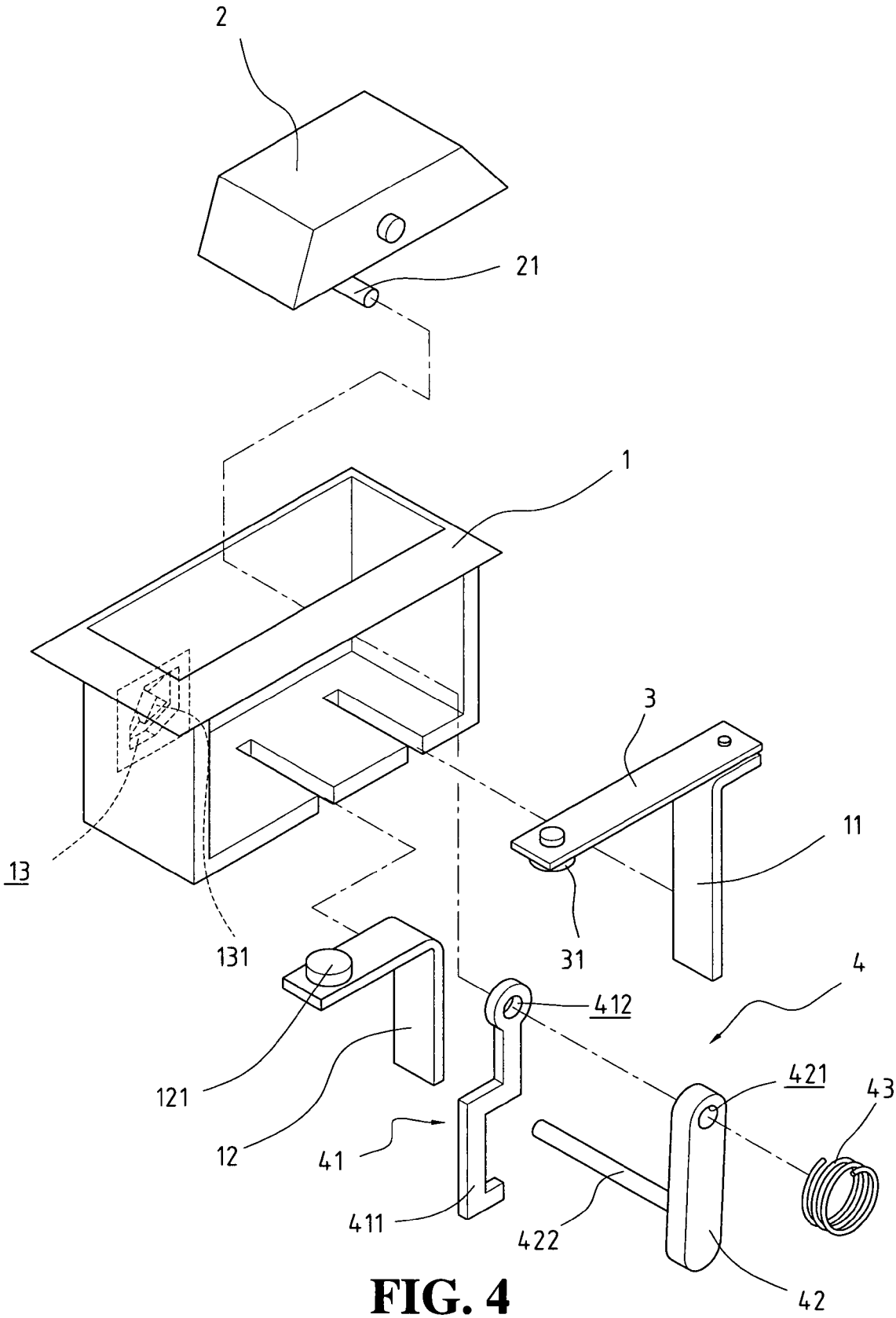
FIG. 4 is an exploded view of the switch device of the present invention.

With reference to the drawings and in particular to FIGS. 1, 2, and 4, a safety switch device comprises a case 1 having an open top and a switch 2 pivotally engaged with the open top of the case 1. The switch 2 includes a connection rod 21 extending from a side and the case 1 having a ramp 13 defined in an inside thereof. The ramp 13 includes at least two sections with different heights and a protrusion 131 with a polygonal outer periphery extending from a center of the ramp 13.

A first terminal 11 and a second terminal 12 are respectively extended through the bottom of the case 1. A bimetallic plate 3 has a first end fixed to the first terminal 11 and a first contact point 31 connected to an underside of a second end of the bimetallic plate 3. A second contact point 121 is connected to a top of a bent portion of the second terminal 12 and located beneath the first contact point 31.

Figure 7:
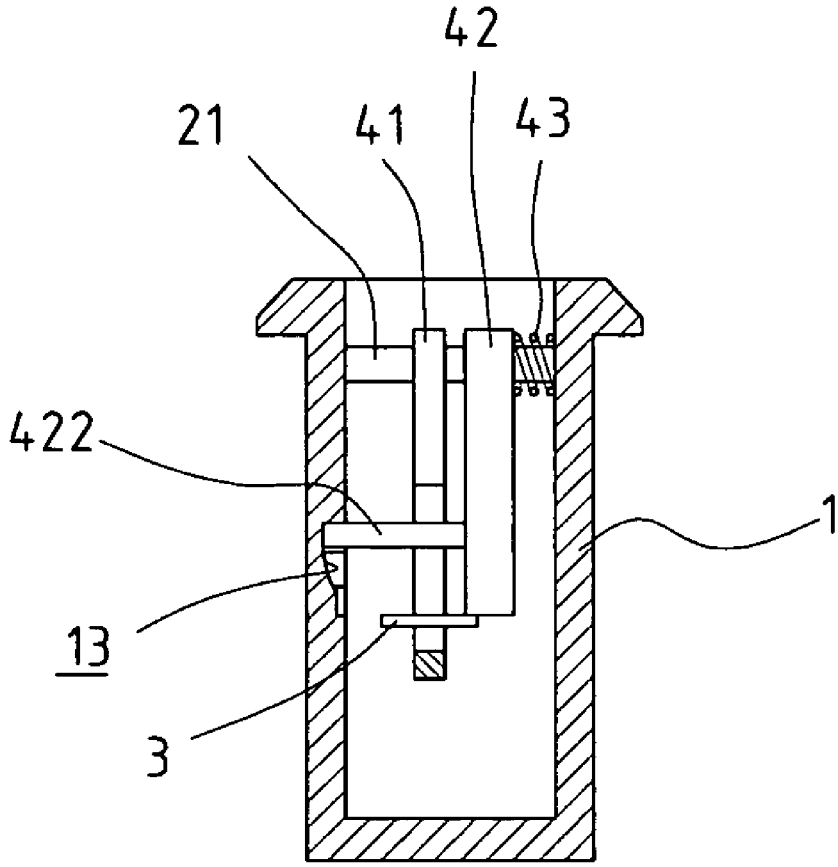
FIG. 7 shows the control member located above the second end of the bimetallic plate when the switch device is in "OFF" status.

A control assembly 4 including a pull rod 41 and a control member 42 is received in the case 1. A ring 412 is connected to a first end of the pull rod 41 and the connection rod 21 extends through the ring 412, so that the pull rod 42 is pivotally connected to the switch 2. A second end of the pull rod 41 has a hook portion 411, which is engaged with the second end of the bimetallic plate 3. The control member 42 has a hole 421, which the connection rod 21 extends through, defined through a first end thereof. Therefore, the control member 42 is pivotally connected to the switch member 2. A probe 422 extends from a second end of the control member 42 and movably engages with the ramp 13. A spring 43 is mounted to the connection rod 21 and is biased between the control member 42 and an inside of the case 1, so that the probe 422 is pushed to engage with the ramp 13. The second end of the control member 42 is movably located above the second end of the bimetallic plate 3 as shown in FIG. 7, which shows the control member 42 is located above the second end of the bimetallic plate 3 when the switch device is in "OFF" status.

Figure 5:
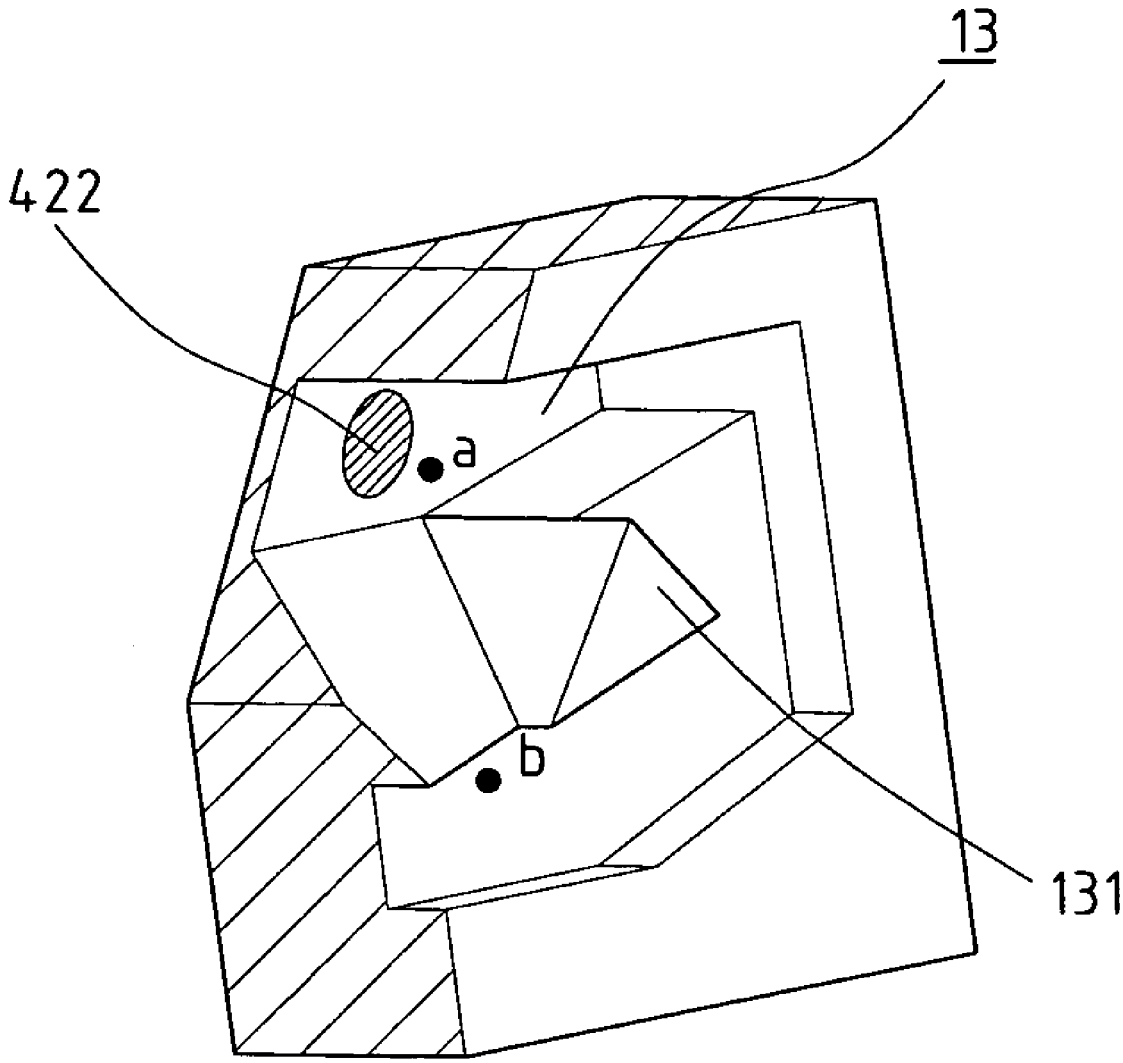
FIG. 5 shows the probe located at the position "a" in the ramp when the switch device is in "OFF" status.
Figure 6:
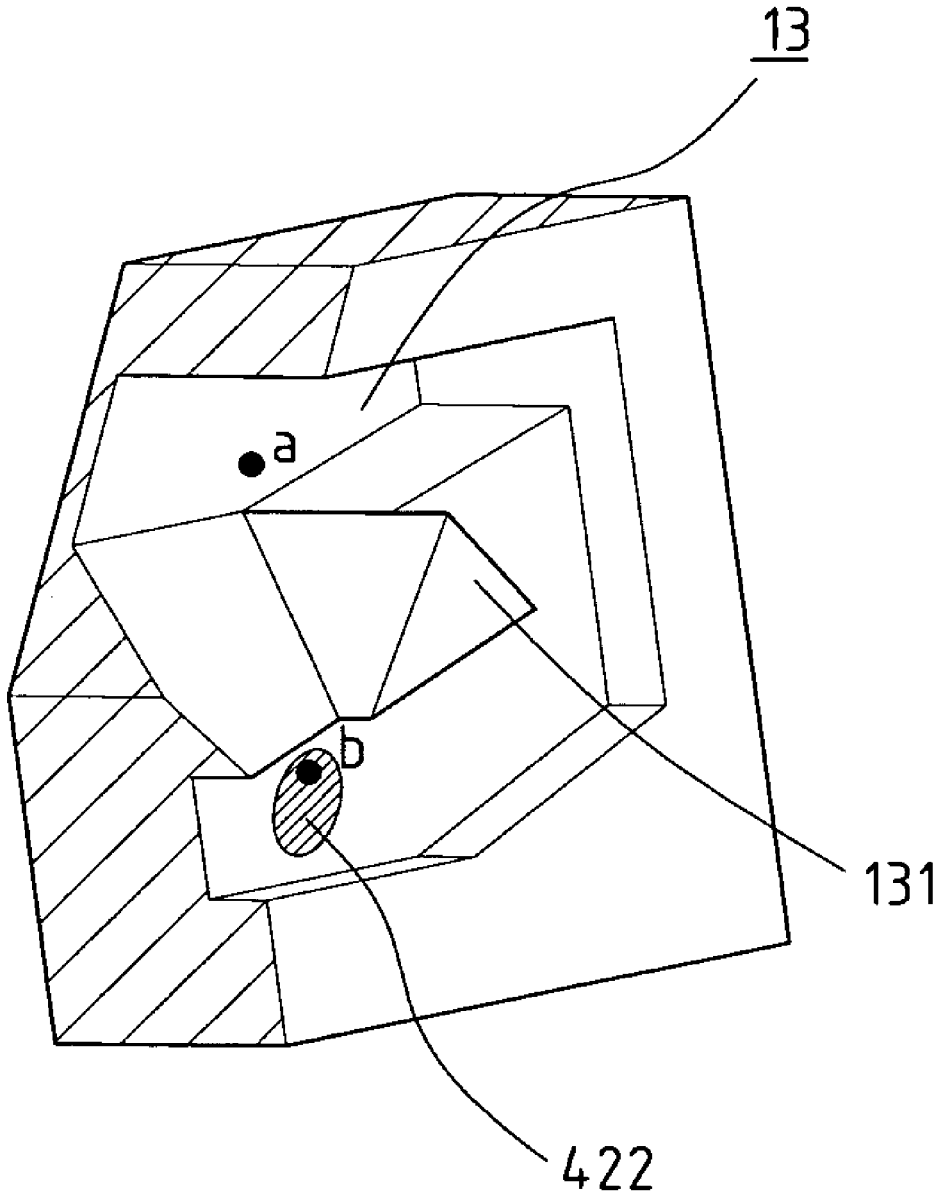
FIG. 6 shows the probe located at the position "b" in the ramp when the switch device is in "ON" status.
Figure 8:
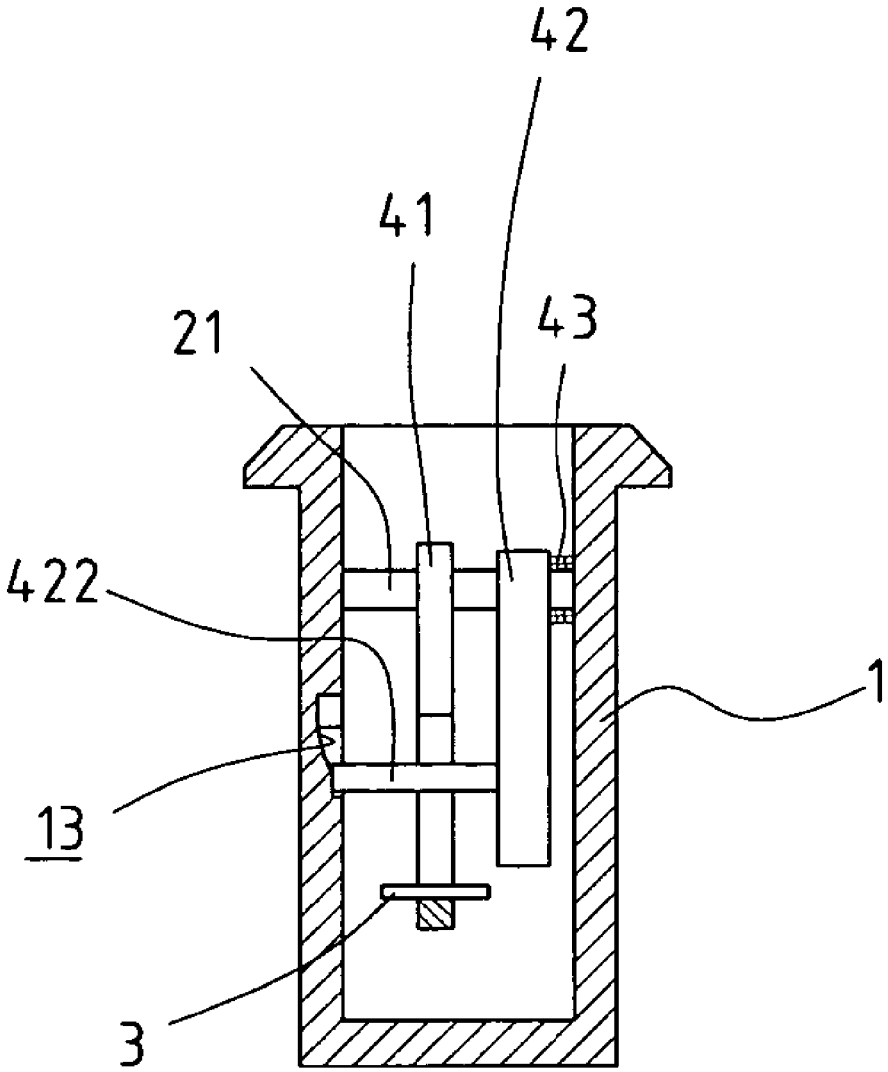
FIG. 8 shows the control member located away from the second end of the bimetallic plate when the switch device is in "ON" status.

When the right end of the switch 2 is pushed downward, as shown in FIG. 1, to set the switch device in "OFF" status, the hook portion 411 lifts the bimetallic plate 3 to disengage the first contact point 31 from the second contact point 121. In this movement, as shown in FIG. 5, the probe 422 is located at position "a" in the ramp 13. As shown in FIGS. 2, 6, and 8, when the left end of the switch 2 is pushed downward, the second end of the control member 42 is lowered to push the second end of the bimetallic plate 3 downward; thus the first and second contact points 31, 121 are in contact with each other. The probe 422 is moved to position "b" in the ramp 13 and the control member 42 is pushed by the shallower section of the ramp 13 to compress the spring 43 and is located away from the second end of the bimetallic plate 3 as shown in FIG. 8.

Figure 3:
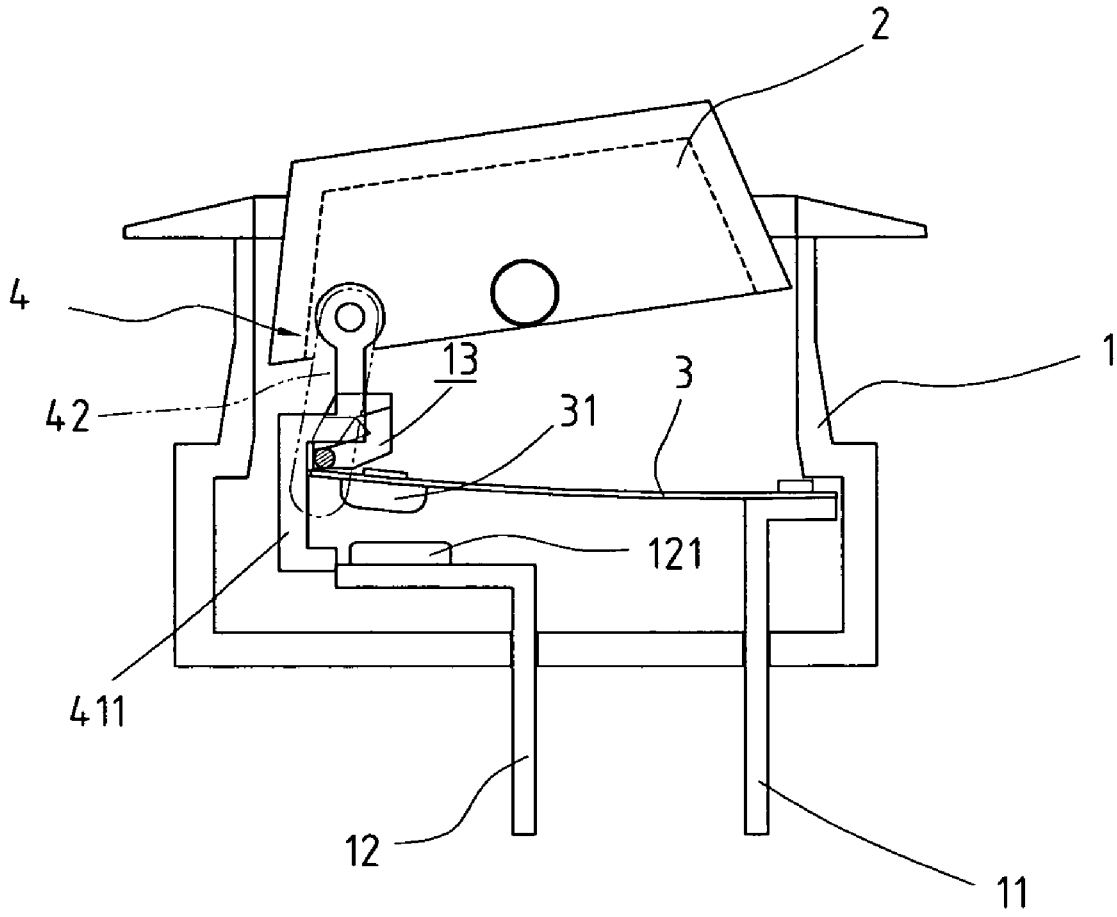
FIG. 3 shows the bimetallic plate is deformed to cut off the circuit when the switch device is overloaded.

In FIG. 3, when the switch device is overloaded, the second end of the bimetallic plate 3 is deformed upward to disengage the first contact point 31 from the second contact point 121 hence to shut off the circuit. Because the second end of the control member 42 is not located above the second end of the bimetallic plate 3, thus the second end of the bimetallic plate 3 is freely deformed.

As what have been shown and described in the embodiment in accordance with the present invention, it should be clear to those skilled in the art to make further embodiments without departing from the scope of the present invention.

What is claimed is:

1. A safety switch device comprising:

a case having an open top and a switch member pivotally engaged with the open top of the case which has a ramp therein;

a first terminal and a second terminal respectively extended through a bottom of the case, a bimetallic plate having a first end fixed to the first terminal and a first contact point connected to a second end of the bimetallic plate, a second contact point connected to the second terminal and located beneath the first contact point;

a pull rod having a first end pivotally connected to the switch member and a second end of the pull rod having a hook portion, the second end of the bimetallic plate engaged with the hook portion; and a control member having a first end pivotally connected to the switch member and a probe extending from a second end of the control member, the probe movably engaged with the ramp and the second end of the control member movably located above the second end of the bimetallic plate.

2. The device as claimed in claim 1, wherein the ramp is defined in an inside of the case.

3. The device as claimed in claim 1 further comprising a protrusion extending from a center of the ramp and having a polygonal outer periphery.

4. The device as claimed in claim 1 further comprising a connection rod extending from the switch member, the first end of the pull rod, and the first end of the control member pivotally connected to the connection rod.

5. The device as claimed in claim 4 further comprising a ring connected to the first end of the pull rod and the connection rod extended through the ring.

6. The device as claimed in claim 4, wherein the first end of the control member has a hole through which the connection rod extends.

7. The device as claimed in claim 1 further comprising a spring biased between an inside of the case and the control member, which is pushed toward the ramp by the spring.

* * * * *